US005906117A

United States Patent [19]

Kim et al.

[11] Patent Number: 5,906,117

[45] Date of Patent: May 25, 1999

[54] WASHING MACHINE

[75] Inventors: Young-Chul Kim, Suwon; Min-Su Cho, Inchun; Yang-Jo Jung, Daejun, all of Rep. of Korea

[73] Assignee: Samsung Electronics Co., Ltd., Suwon, Rep. of Korea

[21] Appl. No.: 09/050,127

[22] Filed: Mar. 30, 1998

[30] Foreign Application Priority Data

Jun. 30, 1997 [KR] Rep. of Korea ..... 97-28999
Jun. 30, 1997 [KR] Rep. of Korea ..... 97-29004
Jun. 30, 1997 [KR] Rep. of Korea ..... 97-29011

[51] Int. Cl.[6] ..... D06F 17/10
[52] U.S. Cl. ..... 68/53; 68/134
[58] Field of Search ..... 68/53, 134

[56] References Cited

U.S. PATENT DOCUMENTS 2,513,844 7/1950 Castner et al. ..... 68/53 X
4,420,952 12/1983 Brenner et al. ..... 68/53
5,473,916 12/1995 Ye ..... 68/134
5,829,276 11/1998 Suh et al. ..... 68/53

FOREIGN PATENT DOCUMENTS 229276 10/1996 Japan ..... 68/53

*Primary Examiner*—Philip R. Coe
*Attorney, Agent, or Firm*—Burns, Doane, Swecker & Mathis, L.L.P.

[57] ABSTRACT

A clothes washing machine has a washing water spurting apparatus for spurting washing water directly upwardly from the center of a pulsator. The washing water spurting apparatus has at least one guide duct and a spurt cap. The spurt cap has a canopy forming a spurt hole. The canopy has a core and an arcuate rim surrounding the core, between which the spurt hole is formed. The core has ribs extending from the core toward a cylindrical inner surface of the arcuate rim. Distal ends of the ribs are spaced a predetermined distance from the cylindrical inner surface. The ribs increase a spurting pressure of the washing water and prevent foreign materials from entering the guide duct downwardly through the spurt hole.

8 Claims, 7 Drawing Sheets

WASHING MACHINE

BACKGROUND OF THE INVENTION

1) Field of the Invention

The present invention relates to a clothes washing machine, and more particularly to a washing machine having a spin basket in which a pulsator is mounted for rotation.

2) Prior Art

Generally, a clothes washing machine is an appliance for washing laundry, in which a pulsator rotates to generate washing current for applying impact to the laundry, thereby washing the laundry.

FIG. 1 shows such a conventional washing machine. As shown, the conventional washing machine includes a housing 10 forming the outer appearance of the washing machine, a tub 11 installed in the housing 10 for containing a predetermined amount of washing water required for washing the laundry, and a spin basket 12 rotatably installed in the tub 11. A pulsator 13 for generating the washing current is mounted on the inner bottom of the spin basket 12, and a driving mechanism 14 for driving the spin basket 12 and the pulsator 13 is arranged under the tub 11. The driving mechanism 14 includes a motor 14*a* and a transmission 14*b*. The motor 14*a* generates the driving power, and the transmission 14*b* selectively drives the pulsator 13 and the spin basket 12 by means of the rotating force of the motor 14*a* transferred through a belt 14*c*.

Further, a drain hose 15 is provided at one side position under the tub 11 and extends out of the housing 10 to drain the washing water from the tub 11.

In the conventional washing machine as constructed above, when an electric power is applied after the laundry is put in the spin basket 12, the washing water is supplied into the spin basket 12 and then the pulsator 13 is rotated in one direction or alternately in opposite directions (i.e., oscillated) by the motor 14*a* to generate the washing current. The laundry flows according to the washing current and is washed by the friction occurring between the clothes and the washing water and the inner wall of the spin basket 12.

However, in such a conventional washing machine, the laundry usually becomes tangled together above the center of the pulsator to thereby diminish the washing performance. That is, the centrifigal force caused by the rotation of the pulsator drives the washing water toward the wall of the spin basket. As a result, the washing water is deeper at the outer periphery of the pulsator, than at the center thereof. Therefore, the clothes come into closer contact above the center of the pulsator. Such gathered laundry above the center of the pulsator goes on rotating in one direction or alternately in opposite directions along with the pulsator, so that the laundry becomes severely tangled together, thereby diminishing the washing performance of the washing machine and even damaging the laundry.

SUMMARY OF THE INVENTION

The present invention has been made to overcome the above described problems of the prior art, and accordingly it is an object of the present invention to provide a washing machine, in which washing water spurts upwardly from the center of a pulsator, so as to disperse the laundry gathered thereabove.

To achieve the above object, the present invention provides a clothes washing machine comprising:

a housing;

a spin basket mounted in the housing;

a pulsator rotatably mounted at a bottom of the spin basket; and a washing water spurting apparatus assembled with the pulsator, the washing water spurting apparatus including at least one guide duct and a spurt cap, the guide duct arranged for guiding a washing water from an inlet to an outlet located adjacent a center of the pulsator, the spurt cap directing upwardly the washing water ejected from the guide duct at the center of the pulsator, wherein the spurt cap comprises a canopy having a spurt hole through which the washing water spurts.

In the spurt hole, a plurality of ribs are arranged to partition the spurt hole.

BRIEF DESCRIPTION OF THE DRAWINGS

The above object, and other features and advantages of the present invention will become more apparent by describing preferred embodiments thereof in detail with reference to the attached drawings, in which.

DESCRIPTION OF A PREFERRED EMBODIMENT

Hereinafter, a preferred embodiment of the present invention will be described in detail with reference to the accompanying drawings, and like elements will be numbered the same in the following description.

Figure 1:
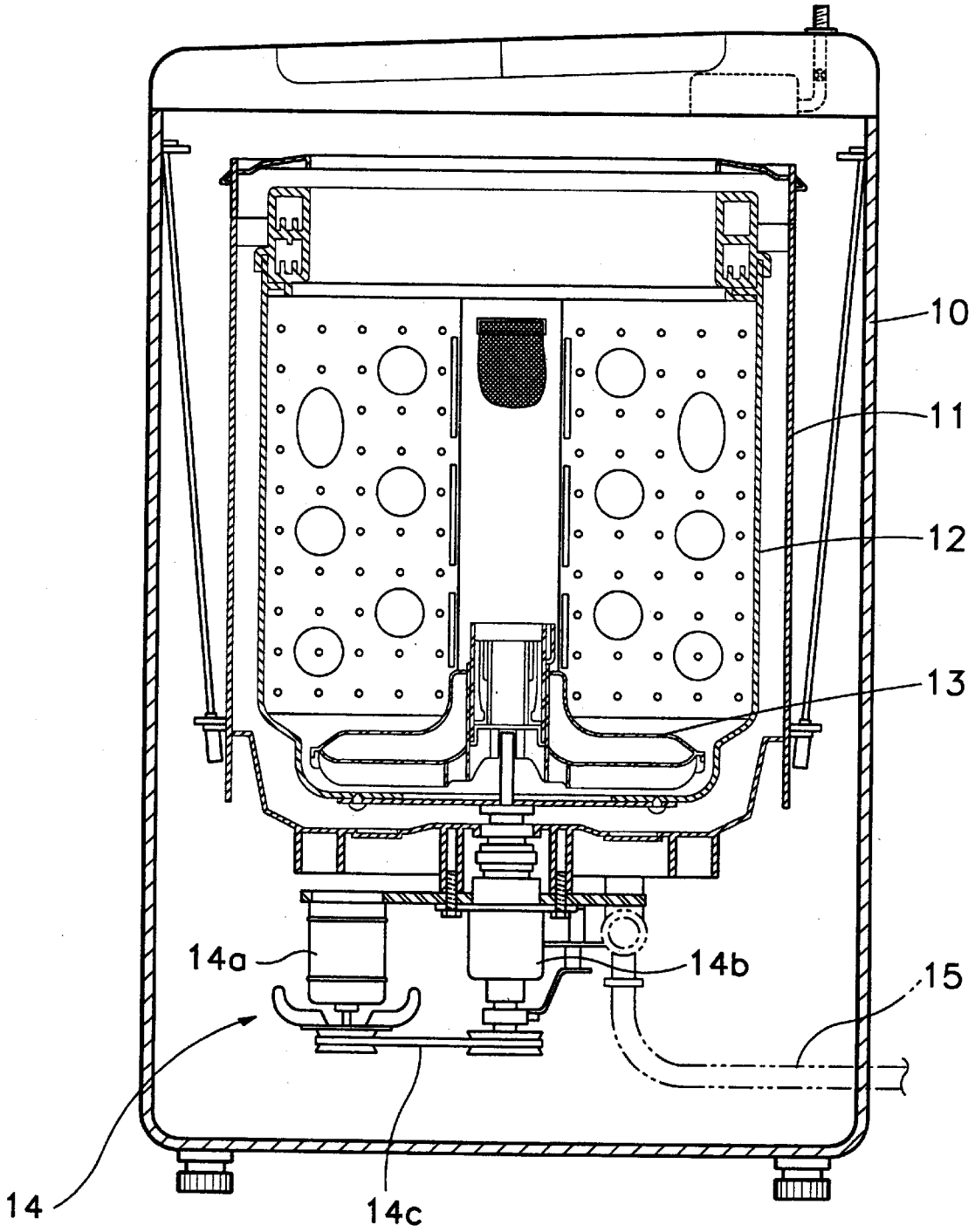
FIG. 1 (PRIOR ART)
FIG. 1 is a sectional view of a conventional washing machine for showing the inner construction thereof.
Figure 2:
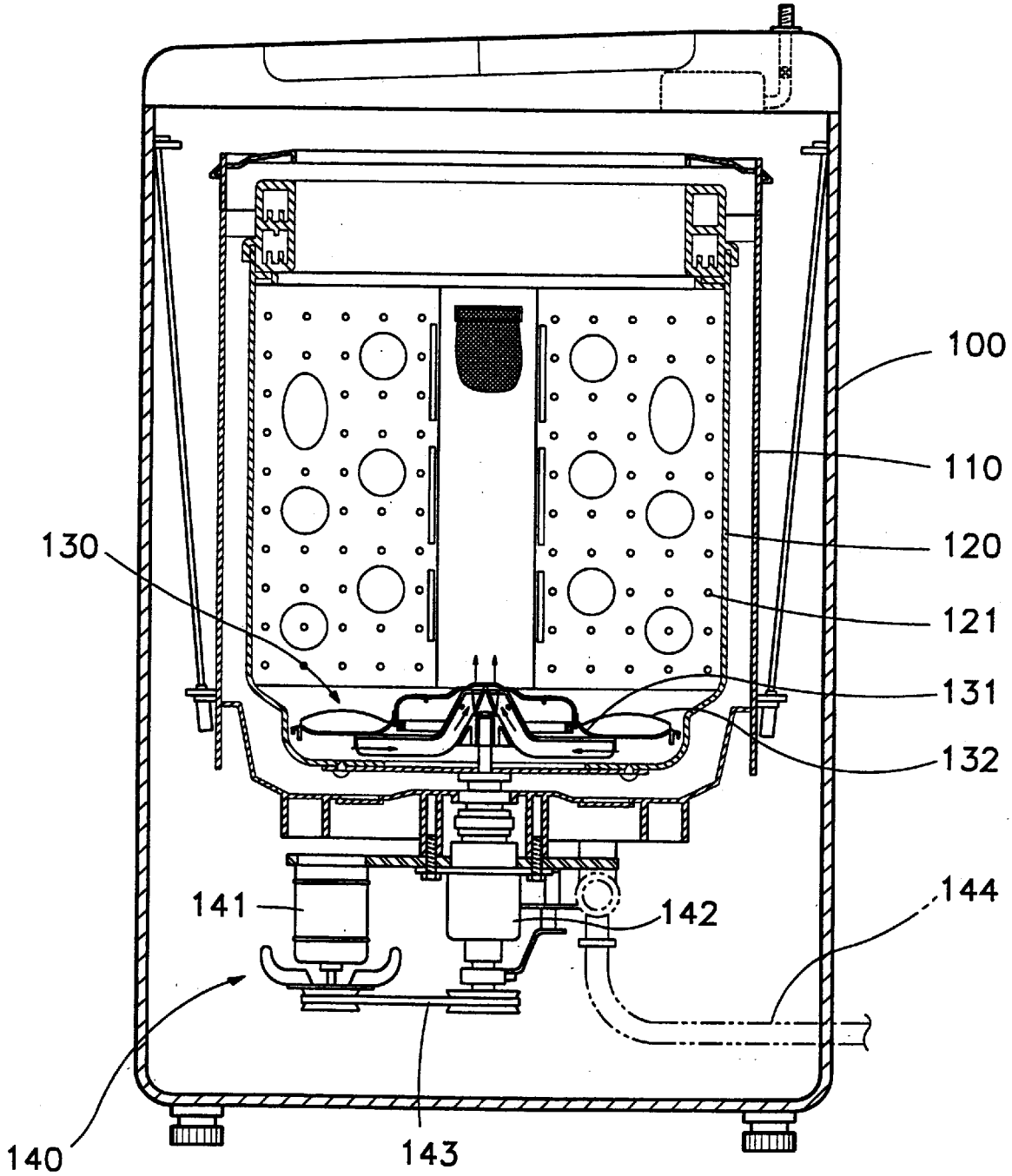
FIG. 2 is a sectional view of a washing machine according to an embodiment of the present invention, which shows the inner construction thereof.

FIG. 2 is a sectional view of a preferred embodiment of a washing machine according to the present invention, for showing the inner construction thereof.

As shown, the washing machine according to the present invention has a housing 100 forming the outer appearance of the washing machine. A control section (not shown) is arranged in an upper portion of the housing 100, and a tub 110 for containing the washing water is mounted in the housing 100. A spin basket 120 formed with a plurality of holes 121 is rotatably installed in the tub 110. On the bottom of the spin basket 120 is installed a pulsator 130 which includes a rotating plate 131 carrying a plurality of blades 132 arranged radially and protruding upward from the upper surface of the rotating plate 131. The pulsator 130 generates the washing current when it rotates in one direction or alternately is oscillated in opposite directions.

A driving mechanism 140 for driving the spin basket 120 and the pulsator 130 is arranged under the tub 110. The driving mechanism 140 includes a motor 141 and a transmission 142. The motor 141 produces the driving power, and the transmission 142 selectively rotates the pulsator 130 and the spin basket 120 by means of the rotating force of the motor 141 transferred through a belt 143. The transmission 142 rotates either the pulsator 130 alone, when the laundry is being washed, or it rotates the spin basket 120 and the pulsator 130 together when the laundry is being dehydrated (spin-drying). A drain hose 144 is provided at one side position under the tub 110 and extends out of the housing 100 to drain the washing water from the tub 110.

The pulsator 130 further includes a washing water spurting apparatus for spurting (ejecting) the washing water upwardly from the center of the pulsator to thereby prevent the laundry from being gathered and tangled.

Figure 3:
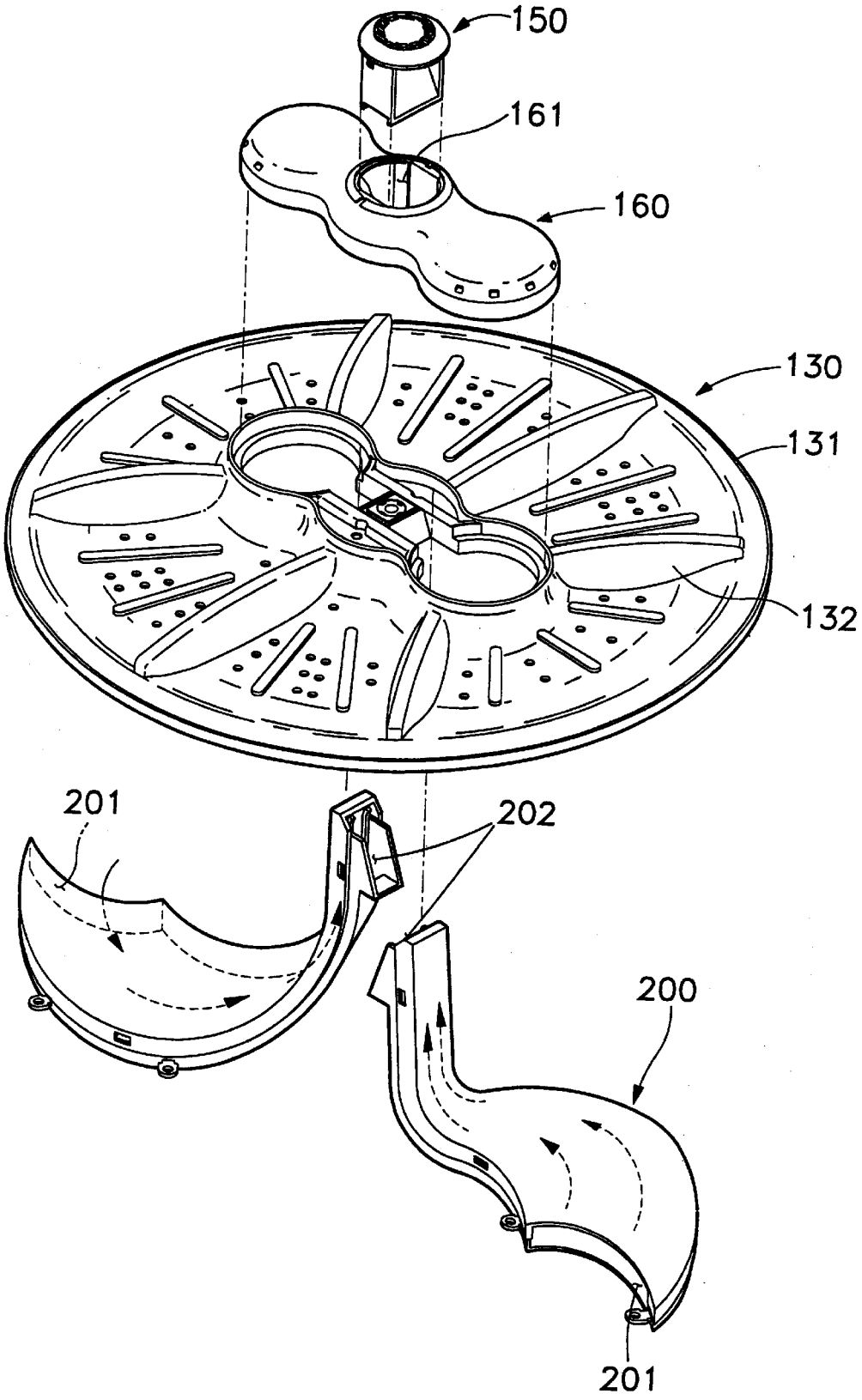
FIG. 3 is an exploded perspective view of a pulsator and a washing water spurting apparatus installed to the pulsator, which are employed in the washing machine shown in FIG. 2.

FIG. 3 is an exploded perspective view for showing in detail the construction of the pulsator and the washing water spurting apparatus according to the present invention.

The washing water spurting apparatus includes a guide duct 200 and a spurt cap 150. The guide duct 200 is fixed to the underside of the pulsator 130 so as to rotate together with the pulsator 130, thereby receiving washing water and guiding the washing water to the center of the pulsator 130. The spurt cap 150 is disposed at the center of the pulsator 130, so as to upwardly direct the washing water, guided by the guide duct 200, to a location above the center of the pulsator 130.

Although the washing water spurting apparatus may include only one guide duct 200, it is preferable to provide a pair of guide ducts 200 fixed to the pulsator 130 in opposing relationship to each other, in consideration of the space available for locating the guide ducts 200 and the need to keep the pulsator 130 dynamically balanced.

Each guide duct 200 has an inlet 201 formed at a radially outer end thereof and an outlet 202 formed at a radially inner end thereof. When the pulsator 130 rotates, the washing water is caused to enter the guide duct 200 through the inlet 201, and exit the guide duct 200 through the outlet 202 in an upward direction at the center of the pulsator 130. The cross sectional area of the guide duct 200 gradually decreases from the inlet 201 to the outlet 202, so that the flowing speed of the washing water increases as it goes from the inlet 201 to the outlet 202, whereby a strong upward spurt of the washing water occurs at the outlet 202. Further, the inlet 201 of the guide duct 200 faces in a horizontal direction, while the outlet 202 thereof faces upwardly.

Reference numeral 160 designates a supplementary blade. The supplementary blade 160 is fixed to the pulsator 130 and rotates together with the pulsator 130 to make the vortex of the water current more violent. In the middle of the supplementary blade 160, a cap chamber 161 for receiving the spurt cap 150 is defined. The cap chamber 161 provides a space for interconnecting the outlets 202 to the spurt cap 150.

Figure 4A:
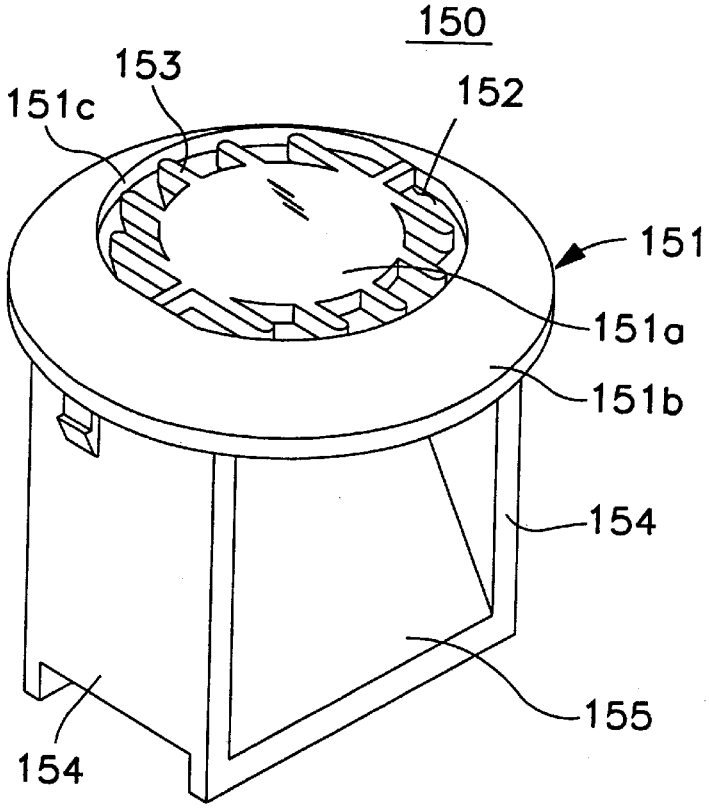
FIGS. 4*a* and 4*b* are a perspective view and a side view, respectively, of a first embodiment of a spurt cap of the washing water spurting apparatus shown in FIG. 3.
Figure 4B:
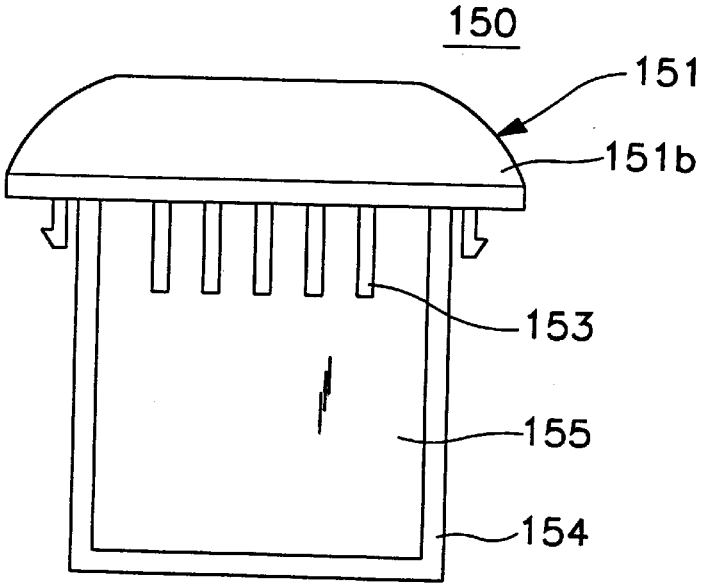
Figure 5:
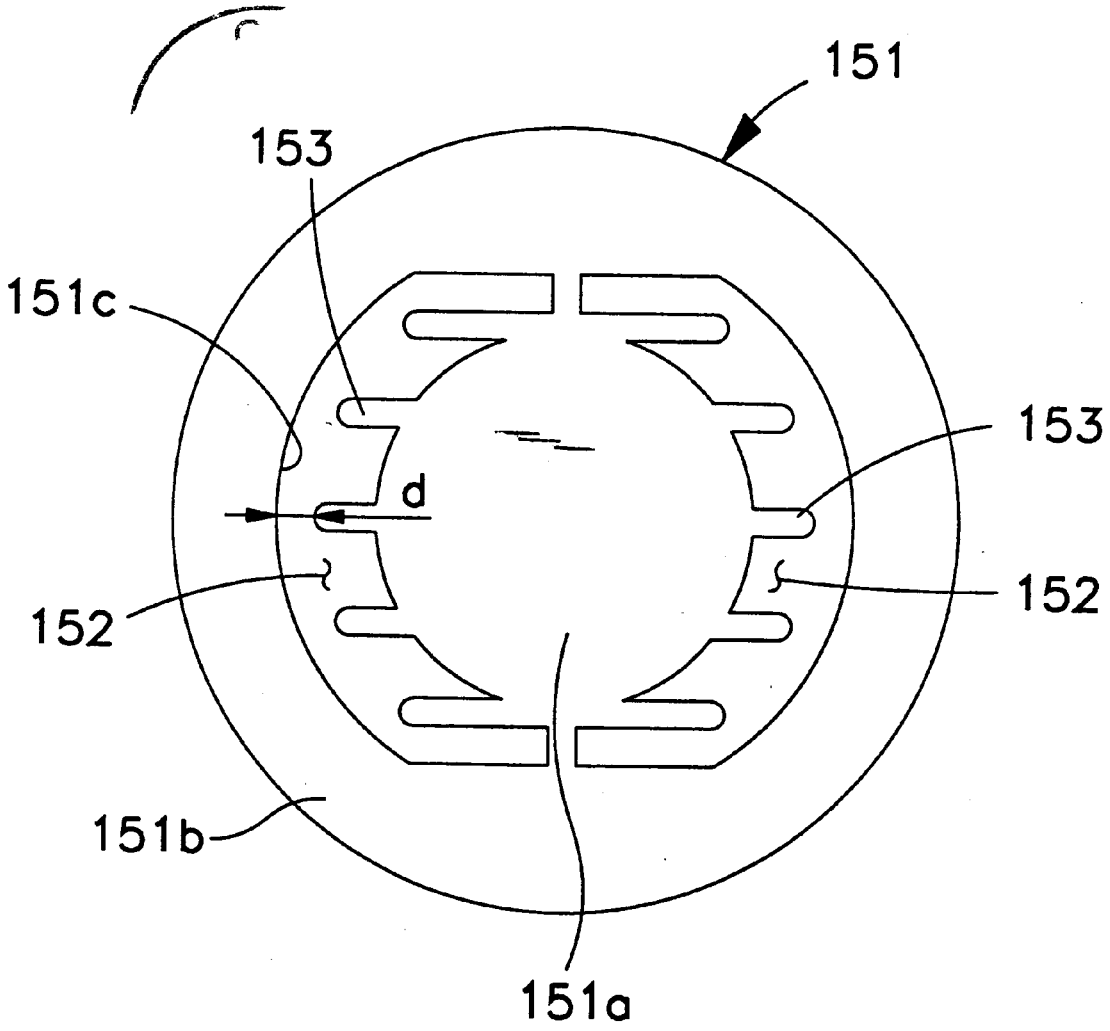
FIG. 5 is a plan view of the spurt cap shown in FIGS. 4*a* and 4*b;*

FIGS. 4*a*, 4*b* and 5 are respectively a perspective view, a side view, and a plan view of a spurt cap of the washing water spurting apparatus shown in FIG. 3. As shown, the spurt cap 150 includes a canopy 151, a pair of side plates 154, and a pair of guide plates 155 (only one plate 155 being visible in FIG. 4*a*). The canopy 151 is shaped like a frusto-arcuate disc having a spurt hole 152 through which the washing water spurts. The side plates 154 extend downwardly from the canopy 151 in opposing parallel relationship. The guide plates 155 are disposed between the side plates 154 to support them, and the plates 155 converge upwardly (see FIG. 2) to guide the washing water from the outlets 202 of the guide ducts 200 to the spurt hole 152.

The canopy 151 includes a core 151*a* and an arcuate rim 151*b* surrounding the core 151*a*. The core 151*a* has a shape of a disc and serves as the ceiling of the canopy 151, and the spurt hole 152 is formed along the circumference of the core 151*a* between the core 151*a* and the arcuate rim 151*b*. The core 151*a* has a plurality of ribs 153 partitioning the spurt hole 152, to thereby reduce the cross-sectional area of the portions of the spurt hole 152 through which the washing water passes, thereby increasing the spurting pressure of the washing water.

The ribs 153 protrude from the circumference of the core 151*a* toward a cylindrical inner surface 151*c* of the arcuate rim 151*b* to partition the spurt hole 152. In this case, when the ribs 153 abut or are immediately adjacent to the cylindrical inner surface 151*c*, impurities such as lint from the laundry may be caught by the ribs 153, and thus the impurities can block off the spurt hole 152 to disturb the spurting operation of the washing water spurting apparatus. Therefore, it is required that such fine impurities as lint be able to pass through the spurt hole 152, while at the same time the ribs 152 prevent relatively large foreign materials such as a hairpin or a button from entering the guide ducts 200 downwardly from above when there is no upward spurting of the washing water from the spurt cap 150. To meet this requirement, the distal ends of the ribs 153 are spaced a desired distance d from the cylindrical inner surface 151*c* of the arcuate rim 151*b* as shown in FIG. 5. It is preferred that the distance d is about 3.5 to 7 mm.

Figure 6A:
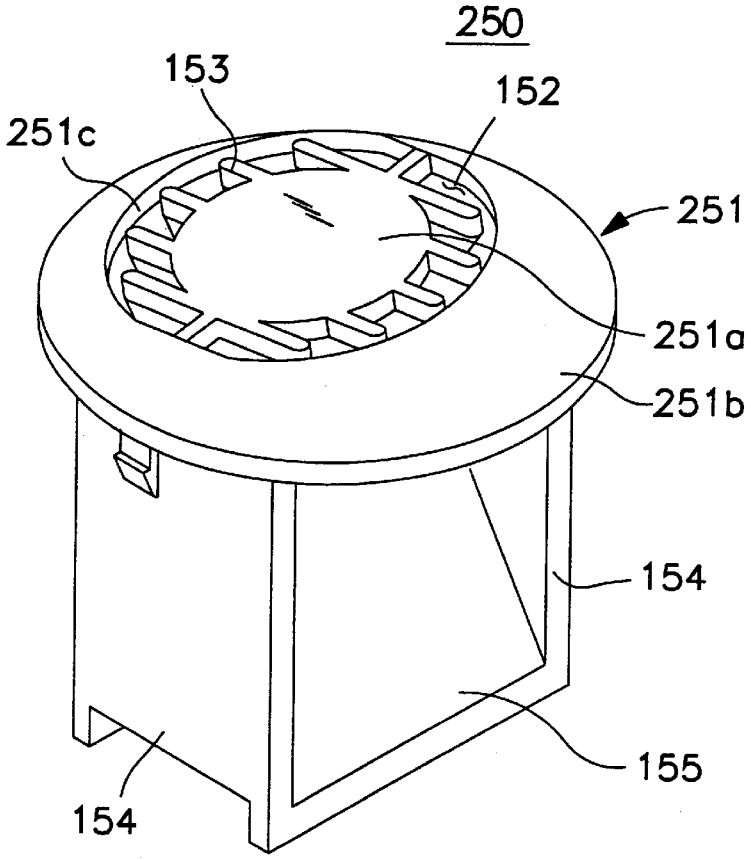
FIGS. 6*a* and 6*b* are a perspective view and a side view, respectively, of a spurt cap according to another embodiment of the present invention.
Figure 6B:
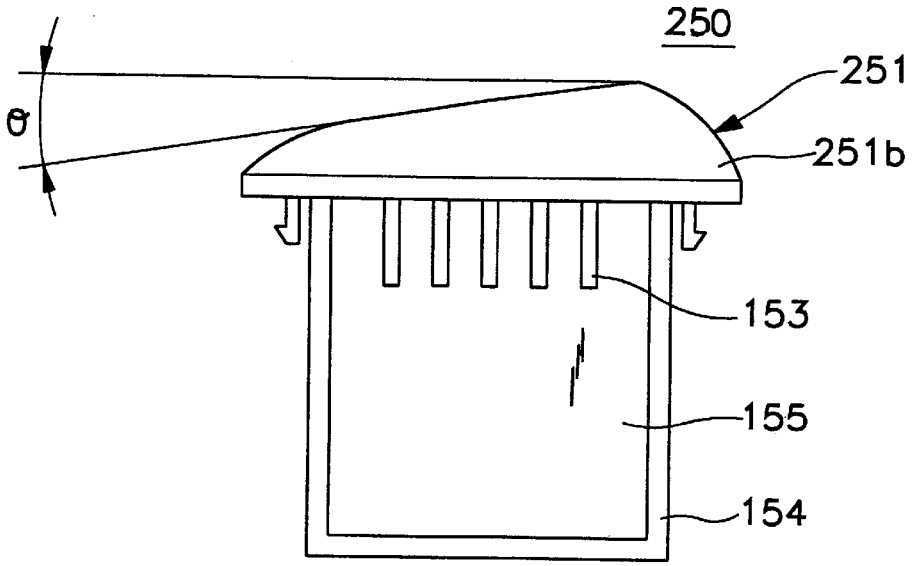

FIGS. 6*a* and 6*b* are a perspective view and a side view, respectively, of a spurt cap 250 according to another embodiment of the present invention, which has a similar appearance to that of the spurt cap in the previous embodiment. Therefore, the same elements will be numbered the same and will not be described in detail.

As shown, the spurt cap 250 includes a canopy 251, a pair of side plates 154, and a pair of guide plates 155. The canopy 251 has a spurt hole 152 through which the washing water spurts. The side plates 154 extend downward from the canopy 251 in parallel opposing relationship. The guide plates 155 are disposed between the side plates 154 to support them, and guide the washing water from the outlets 202 of the guide ducts 200 to the spurt hole 152.

The canopy 251 includes a core 251*a* and an arcuate rim 251*b* surrounding the core 251*a*. The core 251*a* has a shape of a slanted disc and serves as the ceiling of the canopy 251, and the spurt hole 152 is formed along the circumference of the core 251*a* between the core 251*a* and the arcuate rim 251*b*. The core 251*a* has a plurality of ribs 153 partitioning the spurt hole 152, which reduce a sectional area of the portions of the spurt hole 152 through which the washing water passes, thereby increasing the spurting pressure of the washing water.

Preferably, the distal ends of the ribs 153 are spaced a distance of about 3.5 to 7 mm from the cylindrical inner surface 151*c* of the arcuate rim 151*b*, so that fine impurities such as lint can pass through the spurt hole 152, while the ribs 152 prevent relatively big foreign materials such as a hairpin or a button from entering the guide duct 200 downwardly from above, when there is no upward spurting of the washing water from the spurt cap 250.

In the meantime, the core 251*a* of the canopy 251 is slanted at a predetermined angle θ with respect to a horizontal plane as shown in FIG. 6*b*. As a result, when the pulsator 130 rotates in one direction or alternately is oscillated in opposite directions, the spurt cap 250 rotates therewith, whereby, the slanted core 251*a* experiences a friction with the washing water located above the core 251*a*. This friction between the core 251*a* and the washing water generates a turbulence or vortex in the washing water, thereby preventing the tangling of the laundry and improving the washing efficiency. It is preferred that the angle θ of the core 251*a* relative to the horizontal plane be about 10 degrees.

Figure 7:
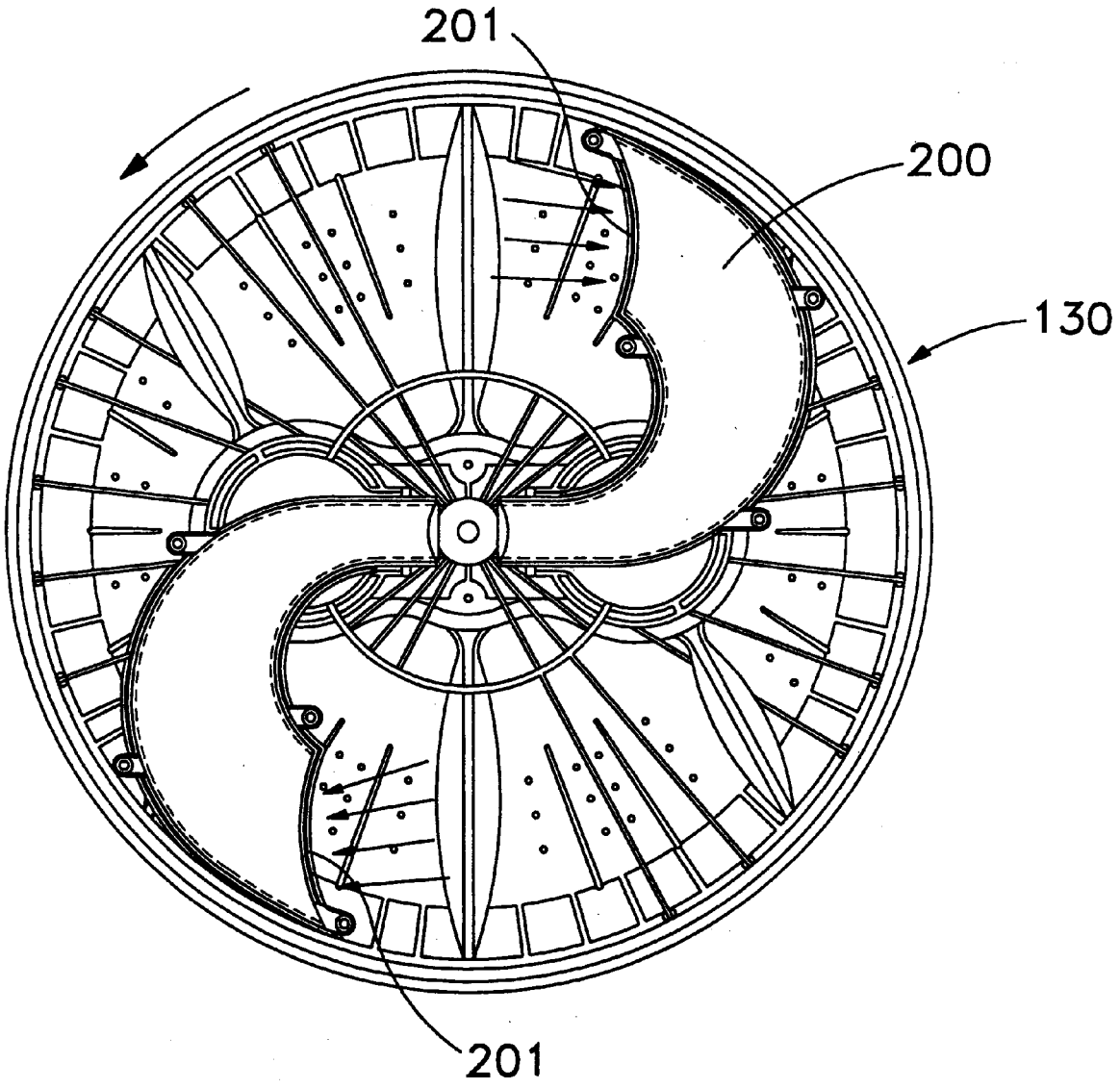
FIG. 7 is a bottom view of the pulsator with guide ducts of the washing water spurting apparatus shown in FIG. 3.

FIG. 7 is a bottom view of the pulsator and the guide ducts of the washing water spurting apparatus shown in FIG. 3, which are assembled with the pulsator. Referring to FIGS. 2, 3 and 7, the operation of the washing machine as constructed above will be described hereinafter.

First, when the washing machine is driven by operating the control section (not shown) after putting the laundry in the spin basket 120, the washing water is introduced into the spin basket 120 and simultaneously into the guide ducts 200. Thereafter, an electric power is applied to the motor 141, whereupon the transmission 142 rotates the pulsator 130 in one direction or alternately oscillates it in opposite directions by means of the rotating force transferred from the motor 141. In this case, the guide ducts 200 fixed to the lower surface 136 of the pulsator 130 rotate together with the pulsator 130. When the pulsator 130 rotates counterclockwise as shown in FIG. 7, the washing water continuously flows into the guide ducts 200 through the inlets 201 due to the rotating force of the pulsator 130.

The washing water introduced into the guide ducts 200 as described above goes on flowing in the guide ducts 200 and then spurts upwardly from the center of the pulsator 130 through the outlets 202. In the meantime, as described above, since the cross sectional area of each guide duct 200 narrows from the inlet 201 to the outlet 202, the washing water flows gradually faster to eventually achieve a strong spurt through the outlet 202 and the spurt cap 150 or 250. Therefore, the laundry gathered above the center of the pulsator 130 during the washing can be dispersed by the strong spurt of the washing water.

As described above, the washing machine according to the present invention includes a washing water spurting apparatus for guiding and spurting the washing water upwardly from the center of the pulsator. The washing water spurting apparatus disperses the laundry gathered above the center of the pulsator to thereby preventing the laundry from being tangled and damaged.

The washing machine is further advantageous in that the ribs partitioning the spurt hole reduce the sectional area of the portions of the spurt hole through which the washing water passes, thereby increasing the spurting pressure of the washing water.

The inclination of the core of the spurt cap 250 produces a friction with the washing water to create a turbulence or vortex which resists entanglement of the laundry.

While the present invention has been particularly shown and described with reference to the particular embodiment thereof, it will be understood by those skilled in the art that various changes in form and details may be effected therein without departing from the spirit and scope of the invention as defined by the appended claims.

What is claimed is:

1. A clothes washing machine comprising:

a housing;

a spin basket mounted in the housing;

a pulsator rotatably mounted at a bottom of the spin basket; and a washing water spurting apparatus assembled with the pulsator, the washing water spurting apparatus including at least one guide duct and a spurt cap, the guide duct arranged for guiding washing water from the inlet to an outlet located adjacent a center of the pulsator, the spurt cap directing upwardly the washing water ejected from the guide duct at the center of the pulsator, wherein the spurt cap comprises a canopy having a spurt hole arrangement through which the washing water spurts.

2. The clothes washing machine as claimed in claim 1, wherein the canopy comprises a core and an arcuate rim, the core having a shape of a disc, the arcuate rim surrounding the core, the spurt hole arrangement being formed between the core and the arcuate rim.

3. The clothes washing machine as claimed in claim 2, wherein the core comprises a plurality of ribs partitioning the spurt hole arrangement.

4. The clothes washing machine as claimed in claim 3, wherein the ribs extend from the core toward a cylindrical inner surface of the arcuate rim, the ribs having distal ends spaced a predetermined distance from the cylindrical inner surface.

5. The clothes washing machine as claimed in claim 4, wherein said predetermined distance is about 3.5 to 7 mm.

6. The clothes washing machine as claimed in claim 2, wherein the core of the canopy is slanted at a predetermined angle with respect to a horizontal plane.

7. The clothes washing machine as claimed in claim 6, wherein said predetermined angle is about 10 degrees.

8. The clothes washing machine as claimed in claim 1 wherein there are two of the guide ducts arranged diametrically opposed to one another, the outlets of both ducts communicating with the spurt hole arrangement of the spurt cap.

* * * * *